US007124698B1

(12) United States Patent
Shen et al.

(10) Patent No.: US 7,124,698 B1
(45) Date of Patent: Oct. 24, 2006

(54) AUXILIARY FACILITIES FOR THE MANEUVERING OF SUBMERGED WATER JET PROPELLED SEA CRAFT

(75) Inventors: Young T. Shen, Potomac, MD (US); Robert J. Etter, Sykesville, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 54 days.

(21) Appl. No.: 10/985,073

(22) Filed: Nov. 5, 2004

Related U.S. Application Data

(63) Continuation-in-part of application No. 10/781,957, filed on Feb. 20, 2004, now Pat. No. 6,932,013, and a continuation-in-part of application No. 10/985,070, filed on Nov. 5, 2004, now Pat. No. 6,983,710.

(51) Int. Cl.
*B63H 11/04* (2006.01)
*B63H 11/107* (2006.01)
*B63H 25/46* (2006.01)
*B63G 8/16* (2006.01)

(52) U.S. Cl. ..... 114/151; 114/330; 440/40; 440/43

(58) Field of Classification Search ..... 114/144 R, 114/146, 150, 151, 312, 330, 337; 440/40, 440/43; 60/221, 222
See application file for complete search history.

(56) References Cited

U.S. PATENT DOCUMENTS 2,330,674 A * 9/1943 Briggs ..... 114/151
3,209,717 A * 10/1965 Campbell et al. ..... 114/151
3,675,611 A * 7/1972 Glass ..... 440/40
4,056,073 A * 11/1977 Dashew et al. ..... 114/151
4,138,963 A * 2/1979 Thompson ..... 440/40
4,455,960 A * 6/1984 Aker ..... 114/151
5,758,592 A * 6/1998 Benson, Jr. ..... 114/330
6,932,013 B1 * 8/2005 Shen et al. ..... 114/151

OTHER PUBLICATIONS

U.S. Nonprovisional Appl. No. 10/781,957 filed Feb. 20, 2004 entitled "Maneuvering of Submerged Propelled Sea Craft".
U.S. Nonprovisional Appl. No. 10/985,070 filed Nov. 5, 2004, Navy Case No. 95,179, entitled "High Speed Braking of Submerged Propelled Sea Craft", now Patent 6,983,710.

* cited by examiner

*Primary Examiner*—Ajay Vasudeva
(74) *Attorney, Agent, or Firm*—Jacob Shuster

(57) ABSTRACT

The hull of a submerged sea craft adjacent its stern end is provided with auxiliary facilities for controlled maneuvering operations under low speed conditions, including steering, stopping and negative thrust backing performed independently of main propulsion of the craft. The auxiliary maneuvering control facilities include a curved channel pipe connected to two angularly related sub-channel pipe sections for selectively controlled outflow of fluid which is pressurized by a maneuvering control pump within the curved channel pipe before outflow through exit openings in the hull in different directions, as negative angle thrust jets and as steering control jets perpendicular to the hull centerline. By use of a sub-channel flow diverting flapper and gate valves at the inlet and exit outlet openings in the hull, all of the maneuvering operations may be performed under selective control.

5 Claims, 3 Drawing Sheets

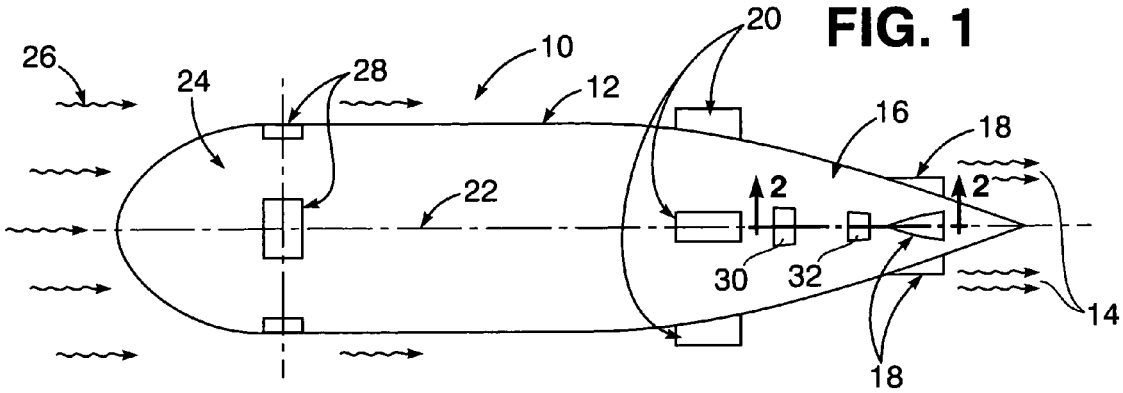
FIG. 1
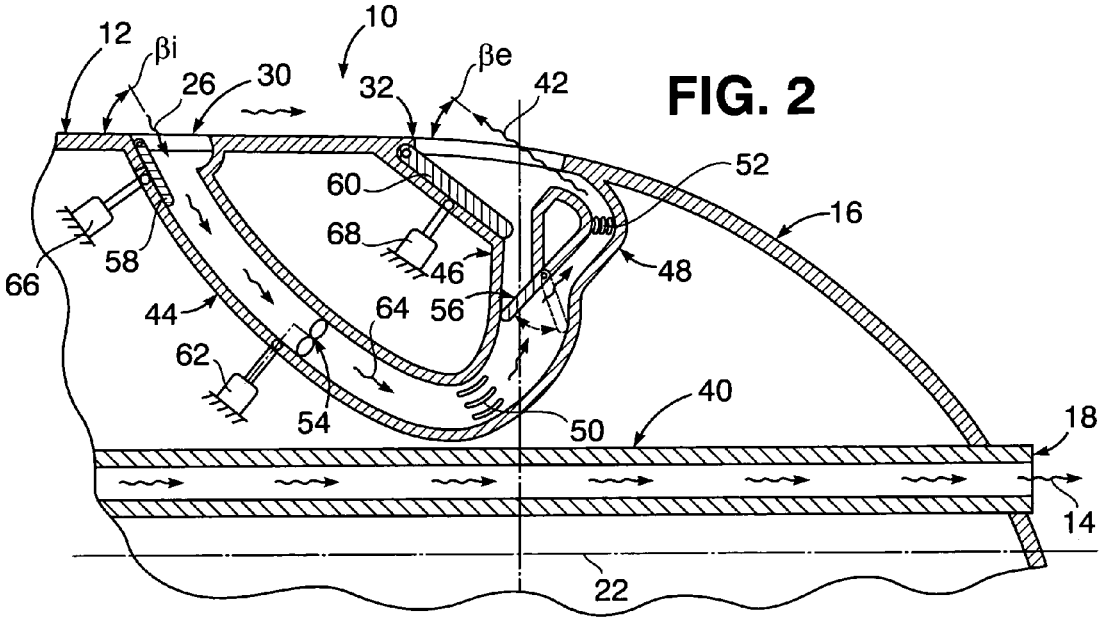
FIG. 2
FIG. 2A
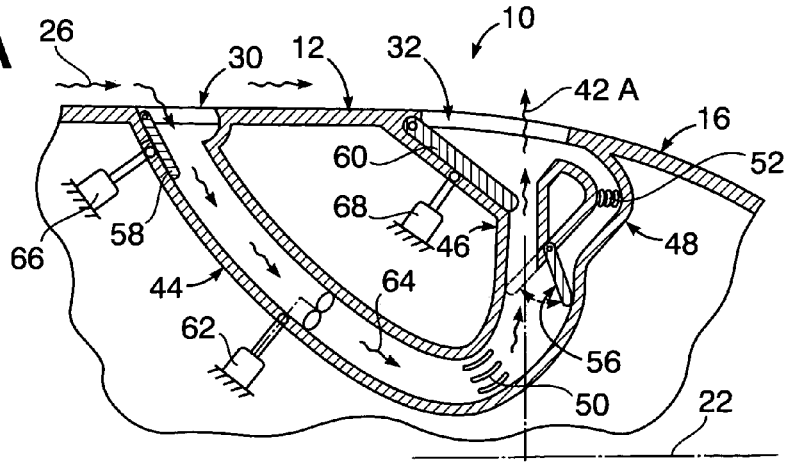

ELECTRIC POWER SUPPLY
78
80
82
MANEUVERING CONTROL SYSTEM
CRAFT SPEED SENSOR
84
GATE CLOSURE CONTROL
86
JET GATE CONTROL
90
GATE OPENING CONTROL
92
PUMP MOTOR CONTROL
94
STEERING THRUST/ CONTROL
HIGH SPEED BRAKING
88

AUXILIARY FACILITIES FOR THE MANEUVERING OF SUBMERGED WATER JET PROPELLED SEA CRAFT

CROSS-REFERENCE TO RELATED APPLICATION

This application is a continuation-in-part of U.S. Nonprovisional application Ser. No. 10/781,957, filed Feb. 20, 2004, Navy Case No. 85,006, entitled "Maneuvering of Submerged Waterjet Propelled Sea Craft", now U.S. Pat. No. 6,932,013, and a continuation-in-part of U.S. Nonprovisional Application Ser. No. 10/985,070, filed Nov. 5, 2004, Navy Case No. 96,179, entitled "High Speed Braking of Submerged Propelled Sea Craft", now U.S. Pat. No. 6,983,710, both of which are incorporated herein by reference.

The present invention relates to the maneuvering of submerged sea craft having water jet propulsors or propulsion.

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION

Heretofore the maneuvering of many water jet propelled sea vessels involved facilities not suitable for fully submerged sea craft. To avoid use of such maneuvering facilities, emergency water jet stoppage was proposed, involving diversion of jet outflow from a main propulsion unit. It is therefore an important object of the present invention to provide better maneuvering for such submerged sea craft without adverse impact on the main propulsion unit.

SUMMARY OF THE INVENTION

In accordance with the present invention, all maneuvering operations for a jet propelled craft are performed by selectively controlled inflow of pressurized fluid through auxiliary flow pipes for controlled outflow of thrust jets emerging from openings in a stern end portion of the hull in different directions. Outflow of the thrust jets in one direction perpendicular to the hull centerline is for vector steering purposes. By outflow of the thrust jets in another direction, at a negative thrust angle, maneuvering with backing and stopping under low speed conditions of the craft may be performed. Such directional outflow of jets emerging from the hull openings is selectively controlled by opening of closure gates under low craft speeds.

BRIEF DESCRIPTION OF THE DRAWING

A more complete appreciation of the invention and many of its attendant advantages will be readily appreciated as the same becomes better understood by reference to the following detailed description when considered in connection with the accompanying drawing wherein:

FIG. 1 is a side elevation view of a sea craft with jet propulsion and maneuvering facilities pursuant to one embodiment of the present invention;

FIG. 2 is an enlarged partial section view taken substantially through a plane indicated by section line 2—2 in FIG. 1;

FIG. 2A is a partial section view corresponding to that of FIG. 2, showing a different operational phase;

DETAILED DESCRIPTION OF PREFERRED EMBODIMENTS

Figure 3:
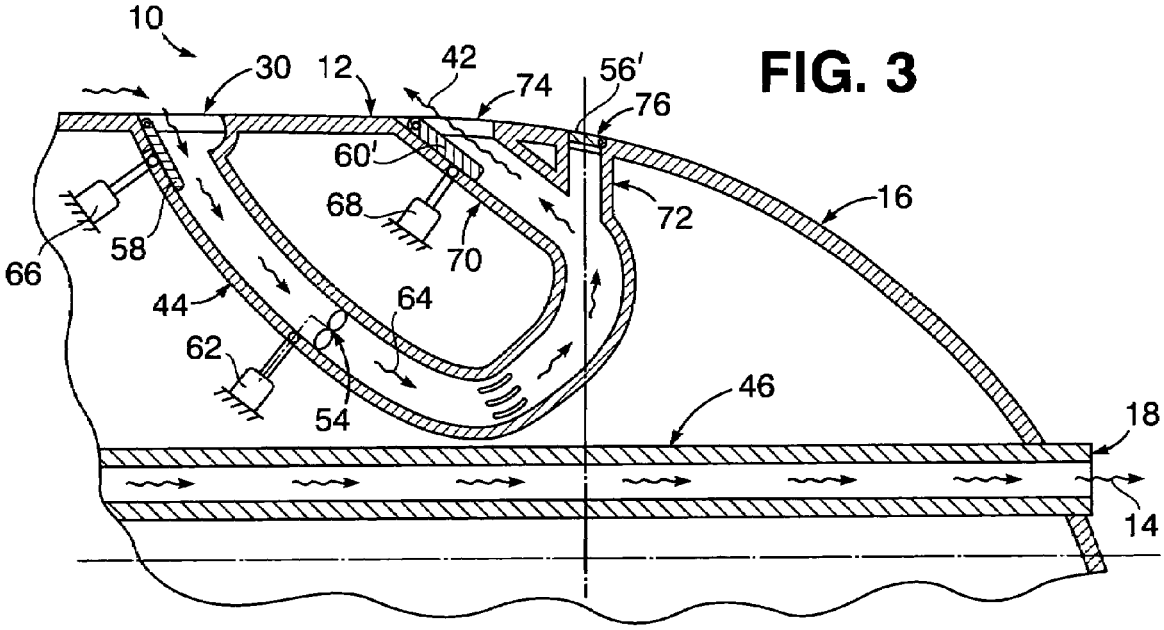
FIG. 3 is a partial section view similar to that of FIG. 2, illustrating another embodiment of the present invention.

Referring now to the drawing in detail, FIG. 1 illustrates an underwater sea craft 10 having an axis-symmetric shaped hull 12 according to one embodiment. The sea craft 10 is propelled in a forward direction by emergence of propelling water jets 14 from any number of main water outflow nozzles 18 such as four on a conical stern end portion 16 of the hull 12. Conventional rudders 20 project from the hull 12 adjacent the stern end portion 16, rearwardly spaced along a hull centerline 22 from a forward bow end portion 24 of the hull 12. Braking devices 28 as disclosed in the copending application Navy Case No. 96,179, Ser. No. 10/985,070, filed Nov. 5, 2004, now U.S. Pat. No. 6,983,710, are positioned on the hull 12.

As shown in FIG. 2, pressurized seawater as the propulsion jets 14 is conducted toward each of the nozzles 18 from a main propulsion pump (not shown) respectively through a main channel 40 within the hull 12 to produce forward thrust, while seawater inflow 26 into the hull 12 enters at an angle ($\beta i$) inlet openings 30. Pressurized seawater emerges from the hull 12 as negative outflow jets 42 from exit outlets 32 at angles ($\beta e$) without any effect on the main propulsion jets 14. Such emergence of the negative outflow jets 42 provides for augmented maneuvering control under low speed conditions, involving the inflow 26 of the seawater through each of the inlets 30 and passage through a curved channel pipe section 44 within the hull 12 to an outlet pipe section 46 extending at a right angle to the hull centerline 22. The outlet pipe section 46 terminates at the exit outlet 32 and is connected to a curved turning elbow section 48 from which the negative outflow jet 42 emerges through the exit outlet 32 when opened as shown in FIG. 2. Guide vanes 50 and 52 are respectively positioned within the pipe sections 44 and 48 to smooth fluid flow therethrough under pressure imposed by blades of a maneuvering control pump 54 positioned within the pipe section 44 upstream of the guide vanes 50 for pressurizing such guided fluid flow. A flapper valve element 56 is pivotally hinged between the pipe sections 46 and 48 for angular displacement from the position shown in FIG. 2 closing the pipe section 46 to an opposite angular position closing the pipe section 48 as shown in FIG. 2A. Valve elements 58 and 60 are pivotally hinged to the hull 12 adjacent to the stern end portion 16 for angular displacement from retracted positions opening the inlet 30 and exit outlet 32 as shown in FIGS. 2 and 2A, to closed positions as hereinafter explained.

The auxiliary maneuvering facilities illustrated in FIG. 2, also includes a pump motor 62 connected to the pump 54 so as to induce pressurized fluid flow of the inflowing seawater having a density ($\rho$) through the curved channel pipe section 44 from the opened inlet 30 at a flow rate (Q) under a velocity (Vi) while exit from the opened outlet 42 is under a velocity (Ve). The valve gates 58 and 60 at the inlet 30 and the exit outlet 32 are held in their open positions by actuators 66 and 68 connected thereto. A negative or reverse thrust (Tj) on the craft 10 is accordingly produced by emergence of the jet 42, wherein the negative thrust (Tj) may be determined by derivation through an equation:

$$Tj=Q\rho(Ve \cos \beta e-Vi \cos \beta i).$$

When the thrust vectoring flapper valve 56 is displaced to the position shown in FIG. 2A, closing the pipe section 48 and opening the pipe section 46, the exit jet 42A emerges from the exit outlet 32 in a direction perpendicular to the centerline 22 to provide a larger side force and moment arm for more effective vector steering under low speed conditions.

Figure 3A:
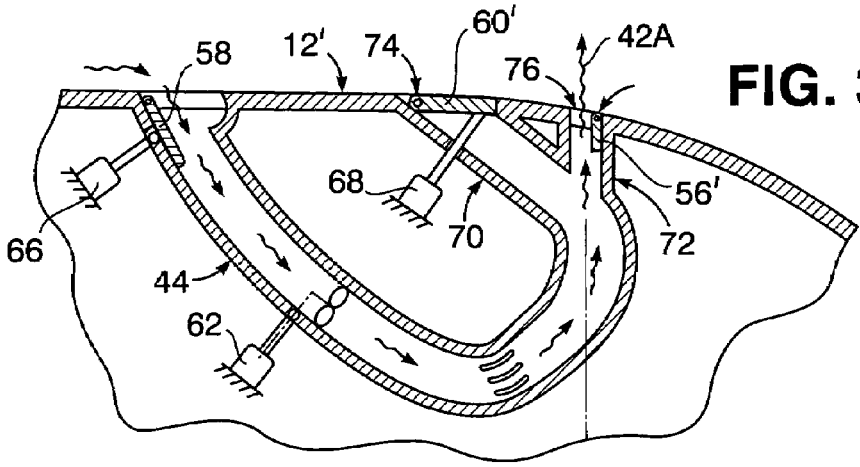
FIG. 3A is a partial section view corresponding to that of FIG. 3, showing a different operational phase.

As an alternative embodiment, the auxiliary low speed maneuvering facility as shown in FIG. 3 involves replacement of the pipe sections 46 and 48 with straight sub-channel pipe sections 70 and 72 connected at an angle to each other to the curved channel pipe section 44 hereinbefore described with respect to FIG. 2. The angularly related sub-channel pipe sections 70 and 72 respectively direct exit outflow from the hull 12 through separate axially spaced exit openings 74 and 76. Gate valves 60' and 56' are respectively hinged to the hull 12 at the exit openings 74 and 76. When the gate valve 60' opens the exit opening 74 and the gate valve 56' closes the exit opening 76 as shown in FIG. 3, the negative thrust jet 42 emerges from the exit opening 74 for low speed maneuvering control. When the gate valve 60' closes the exit opening 74 and the gate valve 56' opens the exit opening 76 as shown in FIG. 3A, the steering jet 42A emerges from the exit opening 76 in a direction perpendicular to the hull centerline 22 to provide the large side force and moment arm for more effective vector steering under low speed conditions.

Figure 4:
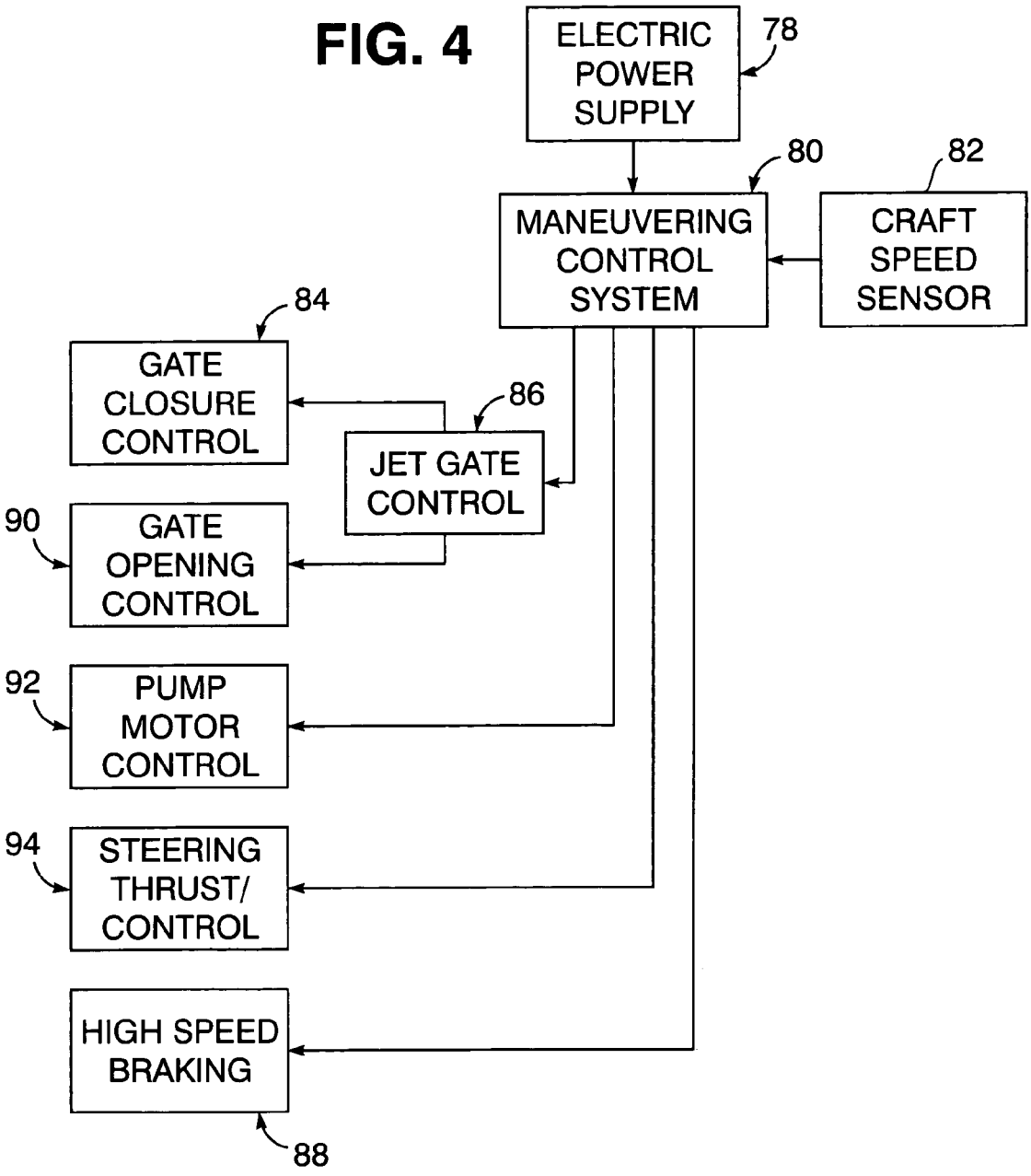
FIG. 4 is a block diagram illustrating operational controls associated with the sea craft shown in FIGS. 1, 2, 2A, 3 and 3A.

It will be apparent from the foregoing description that electrical energy from a power supply 78 as diagrammed in FIG. 4, may be fed through a maneuvering control system 80 under the influence of a craft operator input 83 and travel speed signals from a craft speed sensor 82, to selectively operate the braking devices 28, the pump motor 62 and the gate valves 58, 60 and 56 (or 58, 60' and 56') for enhanced maneuvering of the craft 10 independently of its main propulsion system involving the jet nozzles 18. Accordingly, the maneuvering control system 80 selectively effects gate valve closure 84 or gate valve opening 90 through a jet gate control 86, and at the same time controls high speed braking 88 through the braking devices 28.

Under low speeds such as sea water travel of the craft 10 at less than 15 knots, the control system 80 through the gate control 86 effects positioning of the gate valves 58 and 60 by the actuators 66 and 68 or 68' through the gate opening control 90, and operation of the pump motor 62 through the pump motor control 92 for auxiliary generation of the negative thrust jets 42 to decelerate and stop the craft 10 as it is approaching zero speed. For steering purposes, the flapper 56 is displaced to the position shown in FIG. 2A, or the valve 56' is displaced to the exit outlet open position shown in FIG. 3A, by means of a steering thrust control 94 as diagrammed in FIG. 4. Also the control system 80 may be used to close all of the gate valves 58, 60 and 56 or 58, 60' and 56' when craft maneuvering is not to be used.

Obviously, other modifications and variations of the present invention may be possible in light of the foregoing teachings. It is therefore to be understood that within the scope of the appended claims the invention may be practiced otherwise than as specifically described.

What is claimed is:

1. In combination with a craft having a hull through which flow channels extend to main propulsion jet nozzles connected to a main propulsion pump, maneuvering control means comprising: a maneuvering control pump; a curved channel pipe positioned within the hull; a first sub-channel pipe section and a second sub-channel pipe section extending in angular relation to each other from the curved channel pipe; and controllable gate means for selectively directing flow of pressurized fluid pressurized by said maneuvering control pump from the curved channel pipe into one of the first or second sub-channel pipe sections to undergo exit outflow of maneuvering jets from the hull in different directions; wherein said controllable gate means includes: a first gate valve means hingedly mounted on the hull at a first exit opening in the hull for selectively blocking outflow of the pressurized fluid from the first sub-channel pipe section through the first exit opening in the hull; and a second gate valve means hingedly mounted on the hull at a second exit opening in the hull for selectively blocking outflow of the pressurized fluid from the second sub-channel pipe section through the second exit opening in the hull.

2. The combination as defined in claim 1 including: means for blocking emergence of the maneuvering jets while imposing braking drag on forward movement of the craft.

3. In combination with a craft having a hull through which flow channels extend to main propulsion jet nozzles connected to a main propulsion pump, maneuvering control means comprising: a maneuvering control pump; a curved channel pipe positioned within the hull; two sub-channel pipe sections extending in angular relation to each other from the curved channel pipe; and controllable valve means for selectively directing flow of pressurized fluid pressurized by said maneuvering control pump from the curved channel pipe into one of the two sub-channel pipe sections to undergo exit outflow of maneuvering jets from the hull in different directions; wherein said controllable valve means includes: flapper means hingedly mounted within the hull between the two sub-channel pipe sections for limiting outflow of the pressurized fluid as the maneuvering jets from said one of the two sub-channel pipe sections through one of two exit openings in the hull; and gate valve means hingedly mounted on the hull for selectively blocking outflow from the other of the two exit openings in the hull.

4. The combination as defined in claim 3, wherein said maneuvering jets respectively exit from one of the two exit openings in said different directions at a negative thrust angle direction and in a steering direction perpendicular to a centerline of the hull.

5. The combination as defined in claim 4, including: means for blocking outflow of the maneuvering jets from both of the two exit openings in the hull while braking drag is being imposed on forward movement of the craft.

* * * * *